US005181278A

United States Patent [19]

Peleg et al.

[11] Patent Number: 5,181,278

[45] Date of Patent: Jan. 26, 1993

[54] METHOD OF FORMING BRIEFS

[75] Inventors: Eliezer Peleg, New York, N.Y.; Michael J. Bolin, Clover, S.C.; George A. G. Browder, Jr.; Charles M. Price, both of Winston-Salem, N.C.

[73] Assignee: Sara Lee Corporation, Winston-Salem, N.C.

[21] Appl. No.: 727,475

[22] Filed: Jul. 9, 1991

[51] Int. Cl.[5] ..... A41D 9/00

[52] U.S. Cl. ..... 2/243 R; 2/243 B; 2/402; 2/403; 2/406

[58] Field of Search ..... 2/400, 401, 402, 403, 2/406, 78 R, 78 A, 78 D, 243 R; 11/243 B; 66/171, 175, 177, 176, 178 R

[56] References Cited

U.S. PATENT DOCUMENTS

| | | | |
|---|---|---|---|
| 1,396,185 | 11/1921 | Furber | 2/243 R |
| 2,285,012 | 6/1942 | Burkey | 2/402 X |
| 2,511,720 | 6/1950 | Lacks | 2/402 X |
| 2,588,606 | 3/1952 | Artzt | 2/243 R |
| 2,621,654 | 12/1952 | Wallace, Sr. | 2/403 X |
| 3,111,677 | 11/1963 | Artzt | 2/243 R |
| 3,245,407 | 4/1966 | Mason | 2/400 |
| 3,491,375 | 1/1970 | Beard et al. | 2/224 |
| 3,560,292 | 2/1971 | Butler | 2/243 R |
| 3,604,015 | 9/1971 | Dove | 2/224 |
| 3,985,004 | 10/1976 | Johnson et al. | 66/177 |
| 4,010,627 | 3/1977 | Pernick | 66/177 |
| 4,287,612 | 9/1981 | Tanaka | 2/243 R |
| 4,527,403 | 7/1985 | Fullbright et al. | 66/177 |
| 4,663,946 | 5/1987 | Wright | 66/177 |
| 4,736,468 | 4/1988 | Efird et al. | 2/403 X |
| 5,081,854 | 1/1992 | Lonati | 2/402 X |

FOREIGN PATENT DOCUMENTS

| | | | |
|---|---|---|---|
| 2082803 | 3/1970 | France | 2/402 |
| 2281729 | 3/1976 | France | 2/402 |
| 1604558 | 12/1981 | United Kingdom | 2/403 |

*Primary Examiner*—Werner H. Schroeder
*Assistant Examiner*—Jeanette E. Chapman
*Attorney, Agent, or Firm*—Charles Y. Lackey; William S. Burden

[57] ABSTRACT

An elongated circular knit tube having a central body and a self contained waistband at each end of said central body is flattened to form a double layer of fabric having two longitudinal folded edges. The body portion is severed to remove selected portions therefrom and to divide the tube into two brief blanks. Coursewise extending severed portions are aligned and subsequently sewn together to form the brief crotch and leg openings.

3 Claims, 2 Drawing Sheets

METHOD OF FORMING BRIEFS

The present invention relates to the manufacture of clothing and more particularly to the manufacture of knitted undergarments such as briefs or panties.

The term "brief" as used in this invention relates to various garments comprising a body portion for covering the lower part of a wearer's trunk, generally from the waist downwards to and beneath crotch and having leg openings therein.

Heretofore, briefs have been made either from a plurality of component parts sewn together, or from a single piece as disclosed, for example, in U.S. Pat. Nos. 4,048,819; 3,985,004; and 3,491,375. As disclosed in U.S. Pat. Nos. 4,048,819 and 3,985,004, a preliminary seamless tubular blank is slit from end to end and opened out into a blank for making up into briefs. As disclosed in U.S. Pat. No. 3,491,375, a tubular section is flattened and cut on three sides. The garment is formed by sewing together selected edges of overlapping end and opposed lower portions.

In the present invention, two brief blanks are simultaneously formed from an elongated knit tube having a knit in waistband at each end. The tube is flattened, a generally central fabric portion is removed therefrom and the tube severed generally coursewise and parallel to the waistbands into two brief blanks. The severed portions of each blank that extend generally parallel to the waistband of the blank are then sewn together to form the crotch portion and define the leg openings of the brief. An elastic and/or leg opening binding preferably is attached. An additional crotch panel may be provided if so desired. Crotch insert panels may be formed from the fabric removed from the flattened tube.

One of the primary objects of the invention is the provision of a new and improved process for making a brief of single piece construction.

Another object of the invention is the provision of a method for efficiently manufacturing at relatively low cost one piece briefs.

Still another object of the invention is the provision of a system for constructing briefs from an elongated knit tube with minimum cutting of the fabric and with minimum sewing operations.

Other objects and advantages of the invention will become apparent from the following detailed description taken with the drawings.

DETAILED DESCRIPTION OF THE INVENTION

Figure 2:
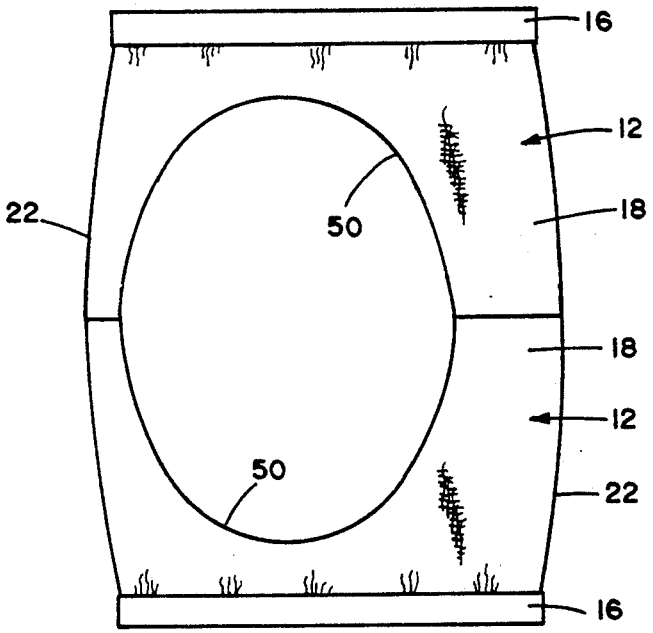
FIG. 2 is a plan view of the tubular section of material after having a portion of fabric removed therefrom and severed into two blanks.
Figure 5:
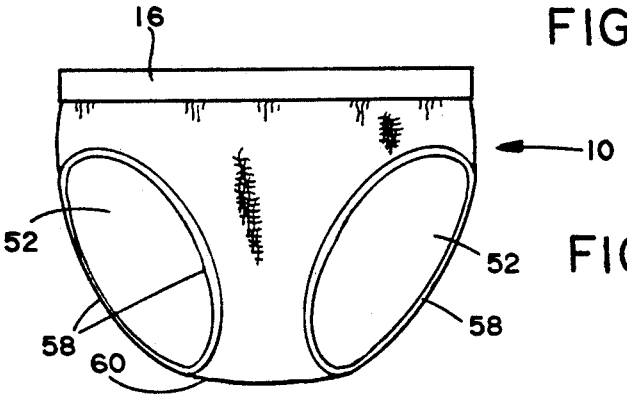
FIG. 5 is a plan view of a finished brief.
Figure 3:
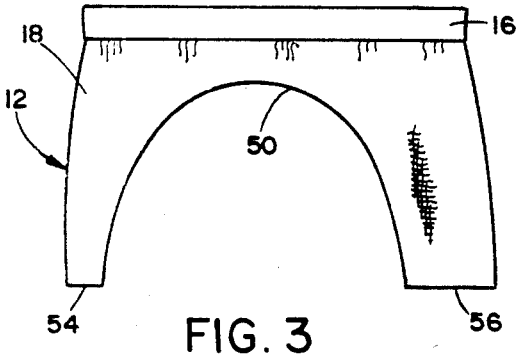
FIG. 3 is a plan view of a brief blank.
Figure 4:
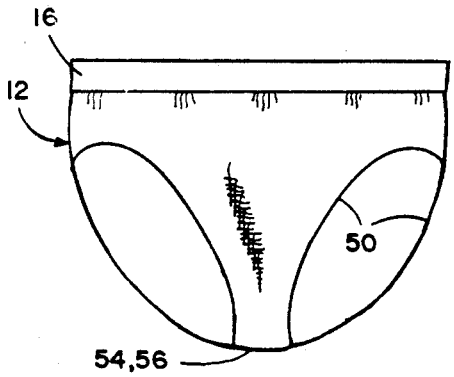
FIG. 4 is a plan view of the brief blank taken from the left side of FIG. 3.

The brief 10, FIG. 5, of the present invention is formed from a brief blank 12 generally of the type shown in FIGS. 2, 3 and 4.

Figure 1:
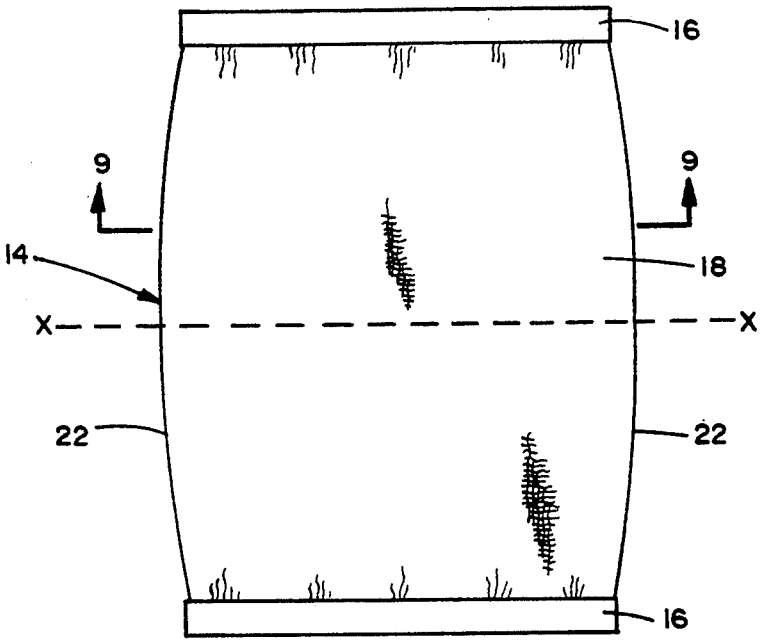
FIG. 1 is a plan view, in flattened condition, of a tubular section of material having a waistband at each end as produced by a circular knitting machine.

Referring to FIG. 1, an elongated tubular section 14 is knitted by wholly rotary knitting on a multi-feed circular knitting machine. The section 14 includes a first waistband 16, an elongated central body 18 and a second waistband 16. The tubular section 14 is of a desired length and diameter. Beginning with each waistband 16,16 and moving towards a central horizontal line, broken line X—X of FIG. 1, the configuration is virtually identical. The section 14 may be of any suitable material, i.e., cotton, cotton/spandex, nylon, nylon/-spandex, polyprophylene, etc. Preferably each waistband contains spandex.

Figure 9:
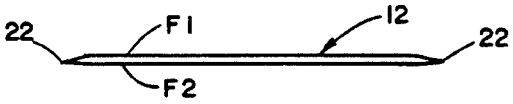
FIG. 9 is a view taken along line 9—9 of FIG. 1 showing the double thickness of fabric.

In accordance with the present invention the elongated tubular section 14 is taken from a circular knitting machine and laid flat, as shown in FIGS. 1 and 2, so that a double thickness of fabric F1 and F2, FIG. 9, having two walewise extending longitudinal folded edges 22,22 is formed. The fabric F1,F2 of the central body 18 is severed according to a prescribed pattern or configuration to remove portions therefrom and also severed generally along the center line X—X or along lines generally parallel thereto to divide the section 14 into two brief blanks 12,12.

Figure 6:
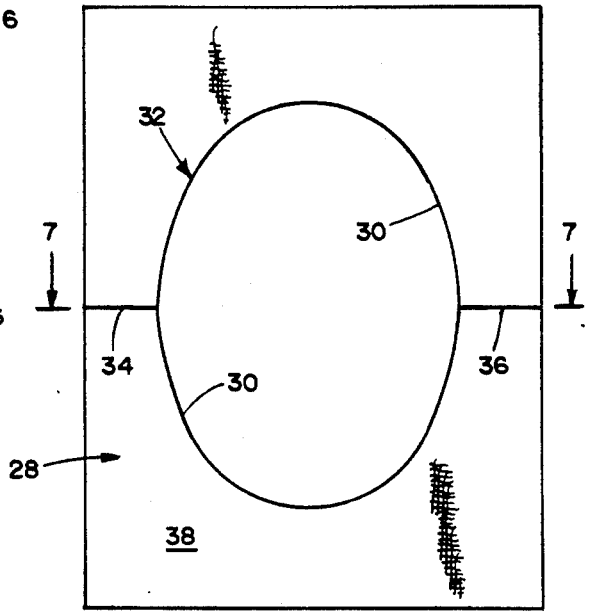
FIG. 6 is a bottom plan view of an open type die having plural cutting edges.
Figure 7:
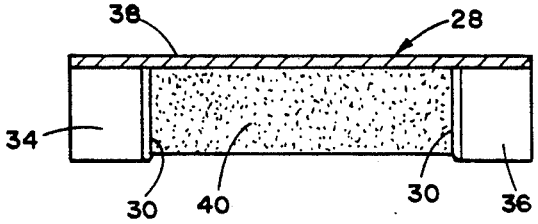
FIG. 7 is a sectional view taken along line 7—7 of FIG. 6.
Figure 10:
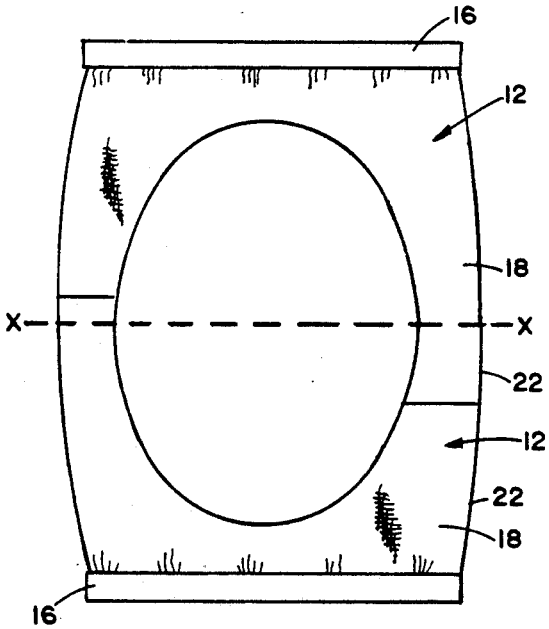
FIG. 10 is a view similar to FIG. 2 but illustrating a modified brief blank configuration.

The flattened layers of fabric of section 14 may be selectively cut by a die 28, having a plurality of cutting edges or surfaces. FIGS. 6 and 7 illustrate an example of one such die having curved cutting edges 30 defining a closed loop 32 and opposed cutting edges 34 and 36 contiguous with and extending outwardly of the closed loop cutting edges. The cutting edges 30,34 and 36 are secured to a plate or support 38. A soft resilient material 40 may be provided in selected areas of the die if the fabric has a tendency to ripple during the die cutting operation. The length or height of the cutting edges may vary depending on the number of superposed layers of flattened tubular sections 14 that are to be cut simultaneously. In the embodiment of FIGS. 6 and 7, the cutting edges 34,36 are aligned. However, they may be positioned generally parallel to each other resulting in blanks cut as shown by FIG. 10, for example. The positioning of the cutting edges may vary depending on the particular size or configuration of the garment and-/or depending on where the crotch closure needs to be positioned.

Figure 8:
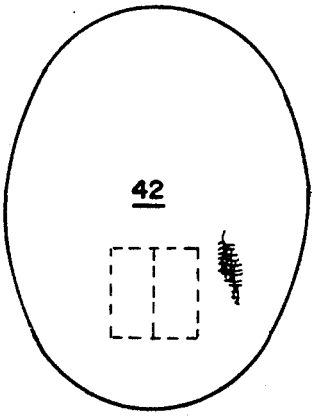
FIG. 8 is a plan view of the fabric portion severed by the die from the flattened tube.

FIG. 8 illustrates a portion of fabric 42 severed by the cutting edges 30 and removed from the elongated central body 18. The fabric 42 may be used for forming additional crotch panels for the briefs if so desired, as shown in broken lines in FIG. 8.

The cutting edges 34 and 36 extend outwardly of the cutting edges 30 defining the closed loop portion and generally extend coursewise or perpendicular to the longitudinal folded edges 22,22. They may be aligned to result in blanks as shown by FIG. 2 or offset and generally parallel to result in blanks as shown, for example, by FIG. 10. When the die 28 is properly aligned with a flattened tubular section 14, the cutting edges 34,36 are positioned to sever the section 14 into two generally equal brief blanks 12,12, the blanks being substantially mirror images of each other as shown by FIG. 2, with each having a knit in waistband.

The particular pattern or configuration of the cutting edges 30 may vary depending upon the desired size and fit of the completed brief. The curved cutting edges define prescribed contours or arcuately shaped severed edge portions 50 which subsequently define the brief leg openings 52. The cutting edge 34 severs the double layer of fabric F1,F2 along a generally coursewise extending line to define severed edge portions 54 on each of the brief blanks 12,12, and cutting edge 36 severs the double layer fabric along a generally coursewise extending line to define severed edge portions 56.

Elastic lace trim, bands, and/or bindings 58 may be secured to the contour edge portions 50 at this time, if so desired. A brief blank 12 is removed from the flattened condition of FIG. 3 and arranged such that the severed edges 54 and 56 are aligned with respect to each other and secured together by stitching 60 or other suitable means to form the leg openings 52 and the crotch portion of the brief.

While the above embodiment of the invention has been disclosed, it will be understood that the details of procedure and construction set out herein are merely by way of example and the invention is to be limited only by the scope of the appended claims.

What is claimed is:

1. A method of constructing a one-piece brief comprising the steps of knitting an elongated tubular section of material, laying the tubular section flat so that a double thickness having two longitudinal edges are formed, aligning with a predetermined portion of that flat tubular section a cutting die having first curved cutting edge portions conforming in size and configuration to a predetermined pattern and defining a closed loop, and second and third cutting edge portions extending outwardly from said first curved portions and generally perpendicular to the longitudinal folded edges, die cutting the double thickness of material to sever a portion therefrom conforming to the predetermined pattern and to divide the flat tubular section into first and second brief blanks, each brief blank having first and second straight severed edge portions connected by curved peripheral edge portions, arranging a brief blank with the first straight severed edge portions in overlapping relation with the second straight severed edge portions, and sewing together the first and second severed straight edge portions to form the crotch portion and leg openings of the brief.

2. The method of claim 1 wherein the knitting of an elongated tubular section of material includes sequentially knitting a first waistband, knitting a central body portion and knitting a second waistband.

3. The method of claim 1 and further including the step of sewing a band to the curved peripheral edge portions.

* * * * *